US005113818A

United States Patent [19]

Bonde et al.

[11] Patent Number: 5,113,818

[45] Date of Patent: May 19, 1992

[54] COMBINATION CRANKCASE GASKET/BAFFLE

[75] Inventors: Kevin G. Bonde, Kiel; Ronald L. Hall, Appleton, both of Wis.

[73] Assignee: Tecumseh Products Company, Tecumseh, Mich.

[21] Appl. No.: 685,611

[22] Filed: Apr. 15, 1991

[51] Int. Cl.[5] ..... F01M 11/06

[52] U.S. Cl. ..... 123/196 W; 123/195 C; 184/6.27; 277/235 B

[58] Field of Search ..... 123/196 R, 196 W, 196 S, 123/195 C; 184/6.5, 6.27; 277/235 B

[56] References Cited

U.S. PATENT DOCUMENTS

| | | | |
|---|---|---|---|
| 3,654,464 | 4/1972 | Jacobsen et al. | 184/6.5 |
| 4,519,348 | 5/1985 | Hamilton | 123/195 C |
| 4,582,170 | 4/1986 | Horiuchi | 277/235 B |
| 4,597,583 | 7/1986 | Inciong et al. | 277/235 B |
| 4,628,878 | 12/1986 | Nakano et al. | 123/196 |
| 4,732,237 | 3/1988 | Nakano | 184/6.5 |
| 4,755,110 | 7/1988 | Bauer et al. | 417/364 |
| 4,766,859 | 8/1988 | Miyaki et al. | 123/196 W |
| 4,909,203 | 3/1990 | Fukuo | 123/196 |
| 4,938,184 | 7/1990 | Martin et al. | 123/195 C |
| 4,944,265 | 7/1990 | Davey | 123/196 |
| 5,000,464 | 3/1991 | Yasui | 277/235 B |
| 5,038,890 | 8/1991 | Tanaka | 184/6.5 |

*Primary Examiner*—E. Rollins Cross
*Assistant Examiner*—Erick Solis
*Attorney, Agent, or Firm*—Baker & Daniels

[57] ABSTRACT

An improved crankcase gasket, for use in an internal combustion engine with a vertical crankshaft, having web portions that substantially cover the oil sump. The construction of the crankcase gasket baffles oil thrown around the inside of the engine by mechanical turbulence and prevents excess oil from reaching the cylinder bore. Gasket material under the valve spring box drain operates as a check valve and eliminates the need for an expensive valve stem valve. Oil temperature is reduced with an increased ability for engine operation at greater angles of crankshaft tilt from vertical.

9 Claims, 2 Drawing Sheets

COMBINATION CRANKCASE GASKET/BAFFLE

BACKGROUND OF THE INVENTION

The present invention relates generally to an internal combustion engine of the type having a vertical crankshaft and more particularly to such an engine having a crankcase gasket and baffle arrangement.

Conventional crankcase gaskets normally have all internal material removed that is not in contact with the sealing surfaces between the crankcase halves. This permits oil to be splashed up into the cylinder bore and a subsequent increase in the lubrication oil temperature results. The cost of conventional crankcase gaskets is a function of their outer dimensions.

Internal combustion engines having a vertical crankshaft, normally have a valve box drain hole at the bottom of the valve box. Conventional valve box drains are simply open holes providing no restriction or resistance to prevent excess oil from being forced up into the valve box. Excess oil in the valve spring box can lead to excessive oil flow past the intake valve stem and guide resulting in higher oil consumption for the engine and excessive carbon deposits on the intake ports. Currently, conventional designs utilize a valve stem seal at considerable expense to reduce the above problem.

An additional problem of current vertical shaft internal combustion engines is oil consumption during operation. Excess oil can be thrown up into the cylinder bore by internal mechanical turbulence and engine orientation. Engine oil sometimes enters the cylinder bore because the engine is tilted during operation.

It would be desirable to provide a vertical shaft engine with a crankcase gasket which simplifies construction and reduces the cost of manufacture of the engine. This and other desirable features are achieved by the present invention.

SUMMARY OF THE INVENTION

The present invention involves providing a vertical shaft internal combustion engine with a crankcase gasket which acts as a gasket between the crankcase halves and acts as a baffle to lubrication oil flow. In a preferred embodiment, the gasket is constructed without removing material not in contact with the sealing surfaces of the crankcase halves. The gasket openings are constructed of a size just large enough to allow passage of the necessary shaft components.

The sump portion of the crankcase containing the engine oil is thereby partitioned from the rest of the crankcase by the remaining gasket material. The extra gasket material acts as a baffle to reduce the amount of lube oil entering the cylinder bore due to mechanism induced turbulence or engine tilt while in operation. This baffling also helps retain oil near the lube system inlet when the engine is tilted from vertical.

The gasket provides a check valve function under the valve box drain hole. The extra gasket material covering the valve box drain hole allows accumulated oil in the valve spring box to drain out but prevents oil from being forced up into the valve spring box due to turbulence within the engine.

An advantage of the crankcase gasket of the present invention is that the invention reduces the amount of lube oil entering the cylinder bore due to mechanism induced turbulence.

Another advantage of the crankcase gasket of the present invention is that the gasket costs the same as a regular gasket because gaskets are priced as a function of their outer dimensions.

Yet another advantage of the crankcase gasket of the present invention is that no valve stem seals are needed because the invention prevents oil from being forced up into the valve spring box through the drain hole and allows oil to drain from the valve spring box A still further advantage of the crankcase gasket of the present invention is that it provides a baffle chamber where lube oil can collect controlling resuspension of oil in the crankcase.

Yet another advantage of the present invention is the significant reduction in the amount of lube oil entering the valve spring box through the drain hole.

A further advantage of the crankcase gasket is that engines incorporating the invention show improvement in the number of degrees the engine can be tilted from vertical and still maintain an adequate supply of lubrication oil to the lube system inlet.

The invention in one form thereof provides an internal combustion engine having a combination crankcase gasket and baffle to minimize the amount of oil splashing up into the upper portion of the crankcase. The internal combustion engine includes upper and lower crankcase halves that join together at a pair of mating edges. The lower crankcase half defines an oil sump for lubrication oil. The combination gasket and baffle has a peripheral portion, clamped between the mating edges of the crankcase halves, and a web portion integral with the peripheral portion extending over said oil sump for impeding the movement of lubrication oil from the oil sump to the upper portion or half of the crankcase. At least one drive member, such as a crankshaft, camshaft or governor, extend vertically from the lower crankcase half to the upper crankcase half and pass through an opening in the combination gasket and baffle.

In accord with another aspect of the invention, a check valve means is provided under a chamber that collects oil in the crankcase. The chamber, such as a valve spring box, is constructed over the gasket. The gasket can bend and seal the chamber to prevent oil from entering the chamber from the oil sump. The gasket is permitted to bend away from the chamber to allow oil contained in the chamber to flow away and back to the oil sump. Crankcase pressure bends the gasket toward the chamber to seal while crankcase vacuum helps open the chamber.

BRIEF DESCRIPTION OF THE DRAWINGS

The above mentioned and other features and objects of this invention, and the manner of attaining them, will become more apparent and the invention itself will be better understood by reference to the following description of the embodiment of the invention taken in conjunction with the accompanying drawings, wherein.

Figure 1:
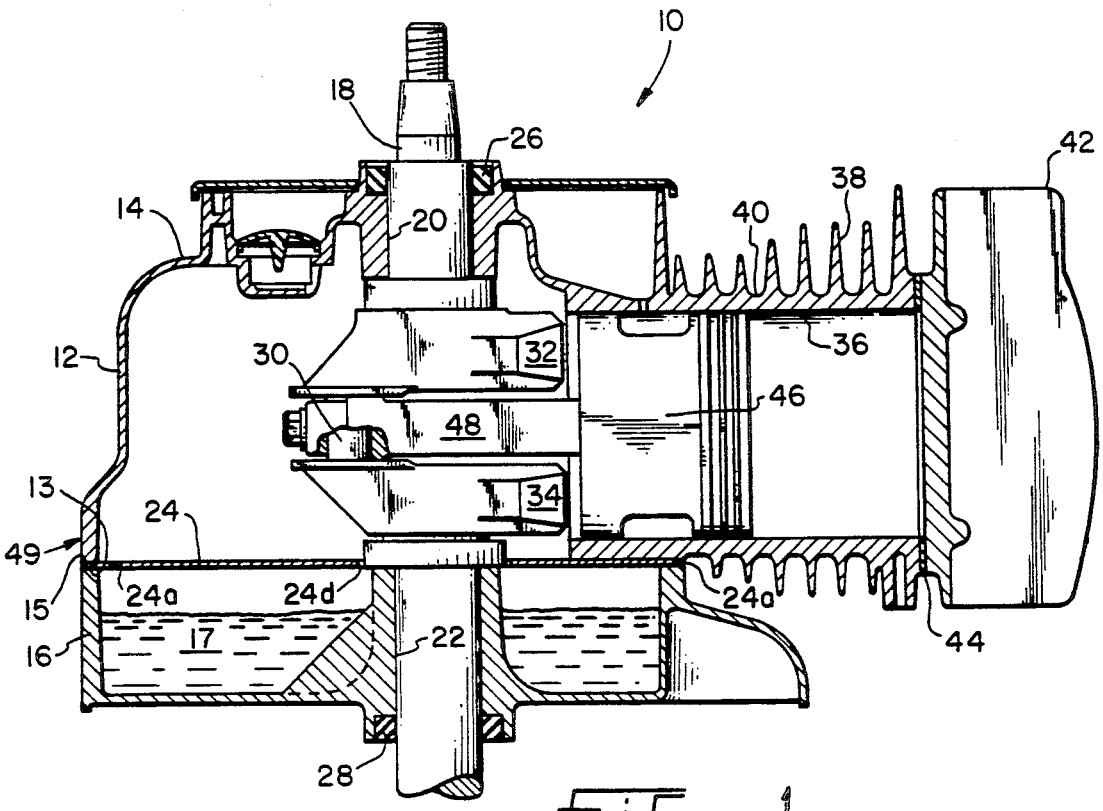
FIG. 1 is a longitudinal cross sectional view of an internal combustion engine in accordance with the preferred embodiment of the present invention.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Referring to the figures, there is illustrated an internal combustion engine 10 in accordance with the present invention. Engine 10 includes a upper crankcase half 12 having a generally horizontal upper wall 14, a lower crankcase half 16 including an oil sump 17, and a vertically oriented crankshaft 18 journalled for rotation therein by bearing journals 20 and 22. Upper crankcase half 12 has a mating edge 13 while lower crankcase half 16 has mating edge 15. A crankcase gasket/baffle 24 according to the invention is disposed between upper crankcase half 12 and oil sump half 16, clamped between mating edges 13 and 15, sealing in lubricating oil. Gasket 24 will be more fully discussed hereinafter.

A upper seal 26 and a lower seal 28 provide sealing of crankshaft 18 with respect to crankcase halves 12 and 16 to prevent migration of oil therepast. Crankshaft 18 includes a crank 30 and counter weights 32 and 34. Horizontally oriented cylinder bore 36 communicates with crankcase half 12 and extends therefrom. Cooling fins 38 on the outside of cylinder 40 provide for dissipation of heat. Cylinder head 42 is attached to the end of cylinder 40 and sealed thereto by cylinder head gasket 44 thereby closing the top of cylinder bore 36. Received within cylinder bore 36 is piston 46 arranged for reciprocation therein. Piston 46 is linked to crank 30 of crankshaft 18 by connecting rod 48.

Figure 2:
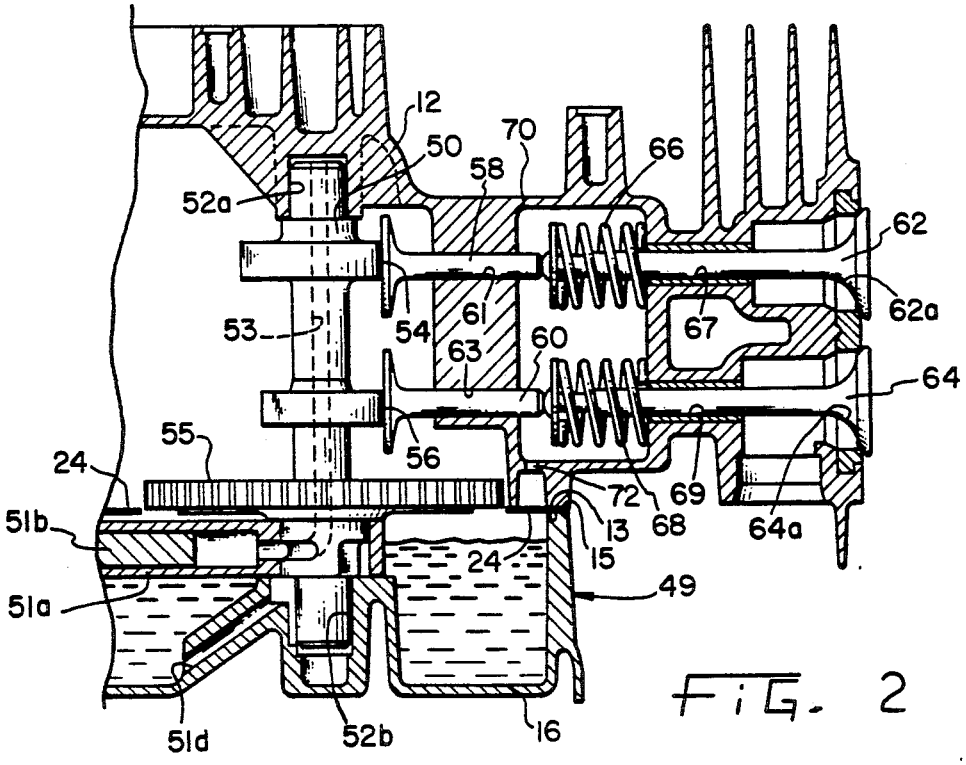
FIG. 2 is a longitudinal cross sectional view of the engine of FIG. 1, illustrating the valve spring box and engine valves.

Referring particularly to FIG. 2, crankcase 49 includes vertically oriented camshaft 50 which is rotatably journalled in bearing journals **52*a* and 52*b*. Pump 51 shown in FIG. 4 includes a sleeve 51*a* that is eccentrically connected to camshaft 50, and a piston element 51*b* connected to crankcase 49. During engine operation, camshaft 50 rotates forcing piston element 51*b* to reciprocate in sleeve 51*a*, drawing oil up through lube system inlet 51*d* and pumping oil through inner passageway 53** into the engine lube system (not shown).

Figure 4:
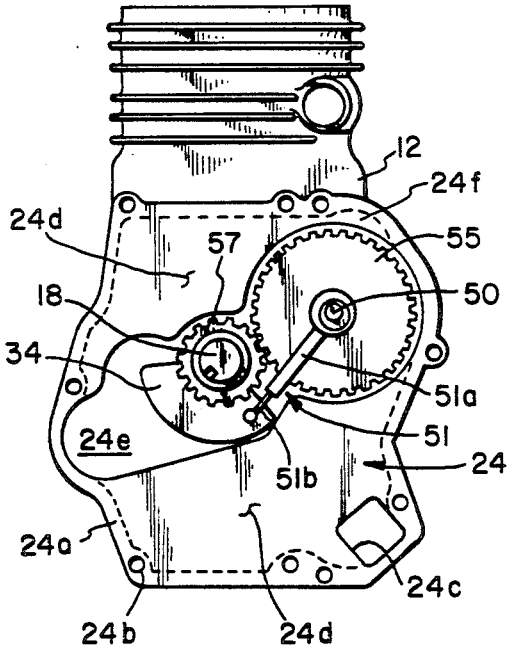
FIG. 4 is a bottom view of the upper crankcase half of the engine of FIG. 1 showing the gasket of the present invention in place.
Figure 5:
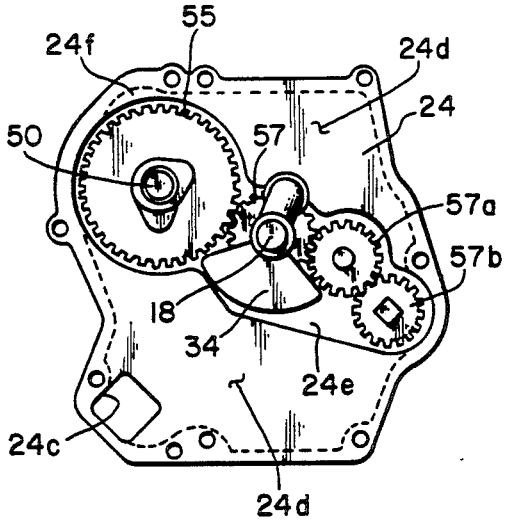
FIG. 5 is a top view of the lower crankcase half of the engine of FIG. 1, showing the gasket of the present invention in place.

Camshaft 50 is connected in synchronous driven engagement with crankshaft 18 by gears 55 and 57, as shown in FIGS. 4 and 5. Camshaft 50 also includes cam lobes 54 and 56 which engage the valve lifters 58 and 60 of intake valve 64 and exhaust valve 62 which are arranged in a side valve configuration. Valve lifters 58 and 60 are disposed within lifter guides 61 and 63 in a wall in top crankcase half 12. Intake valve 64 and exhaust valve 62 are disposed in valve guides 69 and 67 respectively and can seal respective intake port **64*a* and exhaust port 62*a*. Valve springs 66 and 68 surround intake valve 64 and exhaust valve 62 within a chamber such as valve spring box 70. A valve spring box drain hole 72 in the bottom of valve spring box 70 allows lube oil to drain back into oil sump 17**.

Figure 3:
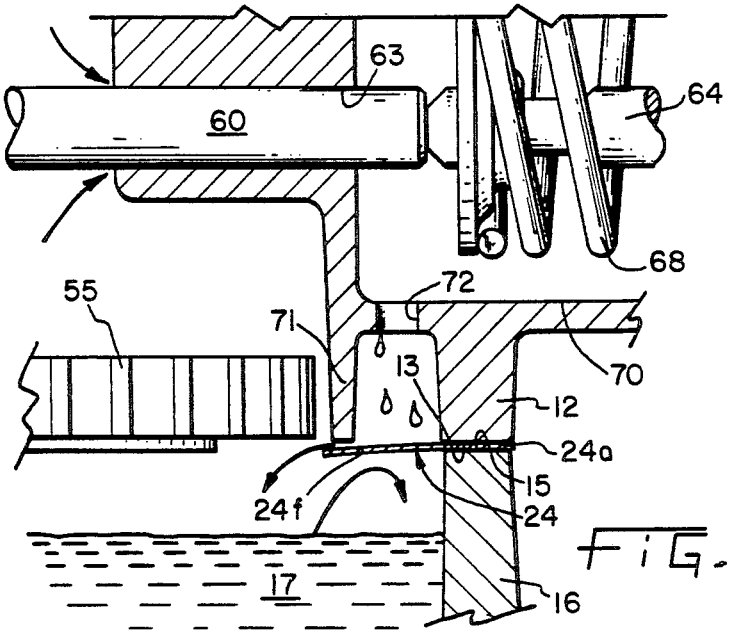
FIG. 3 is an enlarged cross sectional view of the valve spring box and drain hole.

Crankcase gasket 24 is mounted between upper and lower crankcase halves 12 and 16. Bolt holes **24*b* in gasket 24 permit bolts (not shown) to fasten together upper and lower crankcase halves 12 and 16. FIGS. 1 and 3 show outer peripheral edge 24*a* of gasket 24 disposed between the two crankcase halves, 12 and 16, creating a seal to prevent oil leakage out of engine 10**.

Square hole **24*c* is an opening in gasket 24 to extend an oil gage (not shown) through gasket 24** to determine the oil level for routine maintenance.

The gasket 24 of the present invention is made out of a soft, flexible, non-metallic sheet comprising generally of fibrous material, such as cellulose with a rubber binder that seals between the crankcase halves.

As illustrated in FIG. 5, gasket 24 has a web portion **24*d*that substantially covers oil sump 17 defined by lower crankcase half 16. This web portion 24*d* is constructed by cutting opening 24*e* into gasket 24 preferably just large enough for the internal drive members, generally crankshaft 18, camshaft 50, gears 55 and 57, pump 51, idler gear 57*a*, and governor gear 57*b*, to operate within engine 10. The minimum size of the opening 24*e* is such that the internal drive members do not wear against the gasket during operation. A somewhat larger opening 24*e* would also be acceptable if required for engine function, as long as oil in sump 17** is generally confined.

In the absence of gasket baffle 24, oil from oil sump 17 can be thrown up into the cylinder bore 36 by mechanical turbulence caused by spinning crankshaft 18, pump 51 located in oil sump 17, or by engine movement or tilt. Covering the oil in oil sump 17, by crankcase gasket/-baffle 24 and specifically web portion **24*d*, helps prevent excess oil consumption by engine 10 by reducing the amount of oil splashed u into the cylinder bore 36**.

FIG. 3, showing an enlarged view of valve spring box 70 and drain hole 72, illustrates crankcase gasket 24 operating as a check valve under valve spring box drain hole 72. A part of web portion **24*d* is positioned under the valve spring box drain hole 72 that is formed in a side wall of upper crankcase half 12. This area of the web portion 24*d* under the valve spring box drain is flapper portion 24*f***.

Flapper portion **24*f* of gasket 24 extends from the outer peripheral edge 24*a* to the inner wall 71 of the valve spring box drain hole 72 covering the drain hole 72. Flapper portion 24*f* of gasket 24 is cantilevered from edge 24*a* and can flexibly bend from outer peripheral edge 24*a* disposed between the crankcase halves 12 and 16. By bending and sealing toward the drain hole 72, or by bending away from and opening drain hole 72, flapper portion 2*f* acts as check valve. Oil will collect on the top of flapper portion 24*f*, under drain hole 72, causing flapper portion 24*f* to bend away from and break its seal with inner wall 71 The oil will then fall back into oil sump 17**.

During engine operation, as piston 46 reciprocates within cylinder 36, the pressure inside crankcase 47 fluctuates between a vacuum and a pressure. Oil migrates past valve lifters 58 and 60 into spring box 70 to provide lubrication to valves 62 and 6 as illustrated by arrows. Oil then collects within the bottom of valve spring box 70 and falls through drain hole 72.

The pressure/vacuum fluctuation can affect valve box 70 in two ways. The first is through the gap between lifter stems 58 and 60 and lifter guides 61 and 63. The second way is through oil drain hole 72. The gap between the lifter stems 58 and 60 and lifter guides 61 and 63 is very restrictive and filled with an oil film that essentially seals against the pressure/vacuum fluctuations. Flapper portion **24*f* affects the pressure fluctuations through oil drain hole 72**.

Valve box 70 is affected both by the pressure fluctuations caused by the piston 46 and by the pressure/-vacuum fluctuations of the intake and exhaust ports 64*a* and 62*a* via the gap between the valve stems of valves 62 and 64 and valve guides 67 and 69. The net affect inside valve box 70 is a pressure/vacuum imbalance between the valve box 70 and crankcase 49.

When crankcase 49 is in a vacuum state, valve box 70 has a higher pressure forcing flapper portion 24*f* open. Along with allowing the oil to drain out of drain hole 72, oil is also sucked out via a vacuum affect caused by the pressure difference.

As crankcase 49 enters the pressure state, valve box 70 has a lower pressure and flapper portion 24*f* is forced close. This closes off the oil drain hole 72 from any oil near flapper portion 24*f*.

Oil thrown up by mechanical turbulence within the oil sump 17 is prevented from entering the valve spring box drain hole 72 by the flapper portion 24*f* of gasket 24. When oil is thrown up into contact with flapper portion 24*f*, the flapper portion 24*f* will directly prevent oil from being thrown into drain hole 72 and pressure from the oil hitting flapper portion 24*f* will bend flapper portion 24*f* in the direction of drain hole 72 and more firmly seal against inner wall 71, further preventing upward oil flow through the drain hole 72.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An internal combustion engine comprising:

a crankcase having upper and lower crankcase halves joined together at a pair of mating edges, said lower crankcase half defining an oil sump;

a cylinder having a piston disposed therein, said cylinder and piston being located in an upper portion of said crankcase;

a combination gasket and baffle having a peripheral portion clamped between said mating edges of said crankcase halves, and a web portion integral with said peripheral portion extending over said oil sump for impeding the movement of oil from said sump to the upper portion of said crankcase; and at least one drive member operably connected to said piston, extending vertically from said lower to said upper crankcase halves, said gasket web portion having an opening therein through which said drive member passes.

2. The internal combustion engine of claim 1 further comprising a chamber in the upper portion of said crankcase, in which oil collects, said chamber having a drain hole opening into said crankcase and positioned above said gasket, said gasket sealing said chamber hole when oil is splashed on said gasket, said gasket opening said chamber hole to permit oil in said chamber to drain into said sump.

3. The internal combustion engine of claim 2 in which said chamber is a valve spring box.

4. The internal combustion engine of claim 2 in which the sealing of said gasket under said chamber hole is controlled by pressure fluctuations in said crankcase caused by said piston reciprocating within said cylinder.

5. An internal combustion engine comprising:

a crankcase formed as an upper half and a lower half;

a crankcase gasket disposed between said upper and lower halves;

an oil sump for maintaining a pool of lubrication oil;

internal drive members comprising a crankshaft rotatably journalled within said crankcase through said gasket and a camshaft rotatably journalled within said crankcase through said gasket, said camshaft drivingly connected with said crankshaft;

a valve spring box formed within the upper crankcase half, said valve spring box containing valves with springs that engage said camshaft, said valve spring box also containing an oil drain hole for allowing lubrication oil to drain back to said oil sump, said gasket attached under said valve drain only on one side, said gasket covering said valve spring drain, said gasket bending toward and sealing said drain hole when oil is splashed on said gasket from said oil sump said gasket bending away from and opening said drain hole when said drain hole contains oil.

6. The internal combustion engine of claim 5 in which said crankcase gasket includes a web portion constructed by forming gasket openings substantially no larger than necessary to permit passage and operation of said internal drive members through said gasket and prevent wear of gasket by said internal drive members.

7. A crankcase gasket in an internal combustion engine having an oil sump and valve spring chamber drain, said gasket comprising:

web portions that baffle oil flow from the engine oil sump to other parts of said engine

8. The crankcase gasket in an internal combustion engine of claim 7 in which said gasket includes a check valve means constructed by allowing said gasket to cover said valve spring chamber drain, said gasket attached under said drain only on one side, said gasket bending toward and sealing said drain hole when said crankcase is pressurized and when oil is forcefully directed at said gasket, said gasket bending way from and opening said drain hole when said crankcase is under vacuum.

9. The crankcase gasket in an internal combustion engine of claim 7 in which said gasket includes a check valve means constructed by allowing said gasket to cover said valve spring chamber drain, said gasket attached under said drain only on one side, said gasket bending toward and sealing said drain hole when said crankcase is pressurized and when oil is forcefully directed at said gasket, said gasket bending way from and opening said drain hole when said drain hole contains oil.

* * * * *